US008382648B2

(12) United States Patent
Demuss

(10) Patent No.: US 8,382,648 B2
(45) Date of Patent: Feb. 26, 2013

(54) METHOD AND APPARATUS FOR MANUFACTURING BOXES MADE OF PAPER OR CARDBOARD

(75) Inventor: Lutz Demuss, Landau (DE)

(73) Assignee: Mohrbach Verpackungsmachinen GmbH, Rieschweiler-Muehlbach (DE)

( * ) Notice: Subject to any disclaimer, the term of this patent is extended or adjusted under 35 U.S.C. 154(b) by 411 days.

(21) Appl. No.: 12/710,144

(22) Filed: Feb. 22, 2010

(65) Prior Publication Data

US 2010/0216617 A1 Aug. 26, 2010

(30) Foreign Application Priority Data

Feb. 20, 2009 (EP) ..... 09002377

(51) Int. Cl.
*B31B 1/62* (2006.01)

(52) U.S. Cl. ..... 493/123; 493/128; 493/67

(58) Field of Classification Search ..... 493/67, 493/75, 78, 123
See application file for complete search history.

(56) References Cited

U.S. PATENT DOCUMENTS

| | | | | | |
|---|---|---|---|---|---|
| 1,568,608 | A | * | 1/1926 | Klein | 229/5.5 |
| 1,664,739 | A | | 4/1928 | Deline | |
| 1,987,627 | A | * | 1/1935 | Kreider, Jr. | 493/76 |
| 2,115,745 | A | * | 5/1938 | Page | 229/5.5 |
| 2,119,360 | A | * | 5/1938 | Schleicher | 229/125.19 |
| 2,240,445 | A | | 4/1939 | Thaxton | |
| 2,950,849 | A | * | 8/1960 | Ortleb | 229/116.2 |
| 3,016,178 | A | * | 1/1962 | Knocks | 229/116.2 |
| 3,250,186 | A | * | 5/1966 | White | 493/63 |
| 3,643,554 | A | | 2/1972 | Lippman | |
| 4,170,172 | A | * | 10/1979 | Wommelsdorf | 493/296 |
| 4,395,253 | A | | 7/1983 | Goodman | |
| 4,622,026 | A | * | 11/1986 | Ito et al. | 493/104 |
| 5,400,917 | A | * | 3/1995 | Stanton | 220/612 |

FOREIGN PATENT DOCUMENTS

| | | |
|---|---|---|
| DE | 10 2005 054 982 A1 | 7/2007 |
| DE | 20 2006 014 009 U1 | 9/2007 |
| DE | 10 2006 028 824 A1 | 11/2007 |

* cited by examiner

*Primary Examiner* — Hemant M Desai
(74) *Attorney, Agent, or Firm* — Muncy, Geissler, Olds & Lowe, PLLC

(57) ABSTRACT

A method for manufacturing boxes made of paper or cardboard, whereby the boxes have a base or a lid with a glued-on sidewall and the sidewalls are formed from a strip with a beginning, an end, and connecting tabs on a long side. First, the connecting tabs are bent by about 90°. Next, the strip beginning is placed against the lateral surface of a cylindrical matrix, whose cross section corresponds to the cross section of the box, with the aid of a patrix and attached by vacuum. Next, the matrix is rotated. In so doing, the strip is suctioned by vacuum onto the lateral surface and held in place. After application of an adhesive at the beginning or end of the strip, the beginning and end of the strip are glued together. A base along whose periphery an adhesive bead is applied is then pressed onto the connecting tabs. After the adhesive has hardened, the finished box can be removed from the matrix.

17 Claims, 2 Drawing Sheets

METHOD AND APPARATUS FOR MANUFACTURING BOXES MADE OF PAPER OR CARDBOARD

This nonprovisional application claims priority under 35 U.S.C. §119(a) to European Patent Application No. EP 09 002 377, which was filed on Feb. 20, 2009, and which is herein incorporated by reference.

BACKGROUND OF THE INVENTION

1. Field of the Invention

The invention relates to a method for manufacturing boxes made of paper or cardboard, whereby the boxes have a base or a lid with a glued-on sidewall and the sidewalls are formed from a strip with a beginning, an end, and connecting tabs on a long side. It relates further to apparatuses for manufacturing boxes of this type, whereby the boxes have a base and/or a lid with a glued-on sidewall, the sidewalls are formed from a strip with a beginning, an end, and connecting tabs on a long side, and the cross section of the boxes has at least one concave section and at least one convex section.

2. Description of the Background Art

The manufacture of boxes made of paper or cardboard with a cubic form with the use of fully automatic box erecting machines has already been achieved very well. The manufacture of boxes with a non-cubic form, particularly when the cross section of the boxes has at least one concave section and at least one convex section, continues to be problematic, however. Boxes of this type are described, for example, in the German Utility Model Patent No. DE 20 2006 014 009 U1 and in German Patent Application Nos. DE 10 2006 028 824 A1 and DE 10 2005 054 982 A1. The manufacture of said boxes occurs so that an elongated paper or cardboard strip forming the sidewall is glued onto the base formed of paper or cardboard. For this purpose, the paper or cardboard strip has a length that corresponds to the periphery of the base. Connecting tabs, which are connected to the strip by a bending line, are formed on the long side of the strip forming the sidewall.

To manufacture these boxes, the strip forming the sidewall is first glued to form a ring. The connecting tabs are then folded inward. Next, this ring is placed manually on a form, which corresponds to the desired box shape, and fixed in place. Subsequently, the base is glued onto this shaped ring. After removal of the glued unit, a so-called interior mirror, which covers the connecting tabs, is then glued in.

Because the described manufacturing method is substantially manual work, it is not very efficient. This is unsatisfactory.

Other machines for manufacturing heart-shaped boxes are described in U.S. Pat. Nos. 1,664,739, 2,240,445, and 3,643,554. U.S. Pat. No. 4,395,253 describes a machine for manufacturing boxes made of corrugated cardboard.

SUMMARY OF THE INVENTION

It is therefore an object of the present invention to provide a method with the use of which boxes made from paper or cardboard with an irregular cross section can be made completely by a machine.

This object is achieved in an embodiment of the method including the features of bending of the connecting tabs (3) by about 90 degrees, placement of the strip beginning (4) against the lateral surface (11) of a cylindrical matrix (10), whose cross section corresponds to the cross section of the box, with the aid of a patrix (20), attachment of the strip (1) by means of vacuum to a section of the lateral surface (11), whereby the connecting tabs (3) are placed against the base area of the matrix (10), rotation of the matrix (10), whereby the strip (1) is suctioned onto a convex section of the matrix (10) and is held in place, application of an adhesive at the beginning (4) or end of the strip (1), gluing of the strip beginning (4) and strip end, application of an adhesive bead along the periphery of the base (2), pressing of the base (2) and adhesive onto the connecting tabs (3), and removal of the finished box from the matrix (10).

A major advantage of the method of the invention is the complete elimination of manual work, because the entire process proceeds completely automatically. It turned out that during rotation of the matrix the strip is placed precisely not only against the convex sections but also against the concave sections of the matrix, particularly because the placing can be supported by the patrix. In this regard, the patrix guarantees the correct zero positioning of the matrix, the correct positioning of the strip beginning, the placement of the strip in the concave sections of the matrix cross section, and finally the proper gluing of the beginning and end of the strip.

According to an embodiment of the invention, in the case of boxes with more than one concave and convex section, the "rotation" and "attachment" steps are repeated as often as corresponds to the number of concave sections along the box periphery. This means that the method is suitable for boxes whose cross section correspond to a heart, a star, a Christmas tree, etc.

Apparatuses for manufacturing boxes of this type are also the subject of the invention. The apparatuses including a cylindrical matrix (10), whose base area corresponds to the shape of the box to be manufactured, and a patrix (20), which is movable in at least one axis, openings (12), which can be connected to a vacuum source and in this way hold the strip (1) against the matrix (10), are provided in the lateral surface (11) of the matrix (10), the matrix (10) is mounted rotatably, the patrix (20) has an active surface (21), which cooperates with the lateral surface (11) of the matrix (10) and in this manner brings the strip (1) closer to or places it against the matrix (10).

Due to the combined actions of the patrix and matrix, the paper or cardboard strip forming the sidewall is suctioned by the vacuum nozzles against the lateral surface of the matrix, held in place, and shaped until the box base or lid has been glued on. This process occurs program-controlled within a very short time without an operator having to assist manually.

It is understood that the precise feeding of the strip to the matrix is particularly important. For this reason, according to a refinement of the invention, there is a device in front of the matrix for the precise feeding of the strip to the matrix.

Further, the matrix can be placed upstream of a device that bends the connecting tabs on the long side of the paper or cardboard strip, preferably by 90°.

According to a preferred embodiment of the invention, a stop can also be provided, which positions the beginning of the strip precisely relative to the matrix. Said stop can be realized as a light barrier.

To keep the necessary vacuum performance as low as possible, according to a refinement of the invention, the openings in the lateral surface are divided into groups, it being possible to connect each group to the vacuum source via a controlled vacuum connection.

Advantageously, the height of the lateral surface is matched to the height of the strip. This provides optimal positioning of the strip forming the box sidewall.

According to an embodiment of the invention, suction openings are also provided in the base area of the matrix. With the help of these suction openings, an interior mirror to be possibly provided can be brought into position before this strip forming the sidewall is wound.

To assure sufficient vacuum performance, pressure sensors can be activated in the lines from the vacuum source to the matrix.

According to an embodiment of the invention, the matrix is attached removably to an axis of rotation, whereby the axis of rotation is simultaneously the vacuum rotary feedthrough. In this way, the vacuum tubes interfering with rotary movement are unnecessary and the matrix can be rotated endlessly.

According to an embodiment of the invention, the patrix is a traveling ram with a cutting edge, which is matched to the concave section of the matrix. In other words, the cutting edge is formed in such a way that the strip during insertion into the concave sections is optionally bent but naturally not detached.

It is understood that matrixes and/or patrixes are advantageously replaceable to be able to produce boxes of various shapes and sizes without long changeover times.

According to an embodiment of the invention, there is a device before the matrix for pressing the adhesive-coated box base or lid onto the sidewall formed from the strip, the connecting tabs, and/or a possible interior mirror.

Advantageously, adhesive nozzles are provided for applying the adhesive, whether to the beginning or end of the strip or to the box base or lid.

In order to improve the positioning of the strip on the matrix, a guide edge may be provided on the lateral surface.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
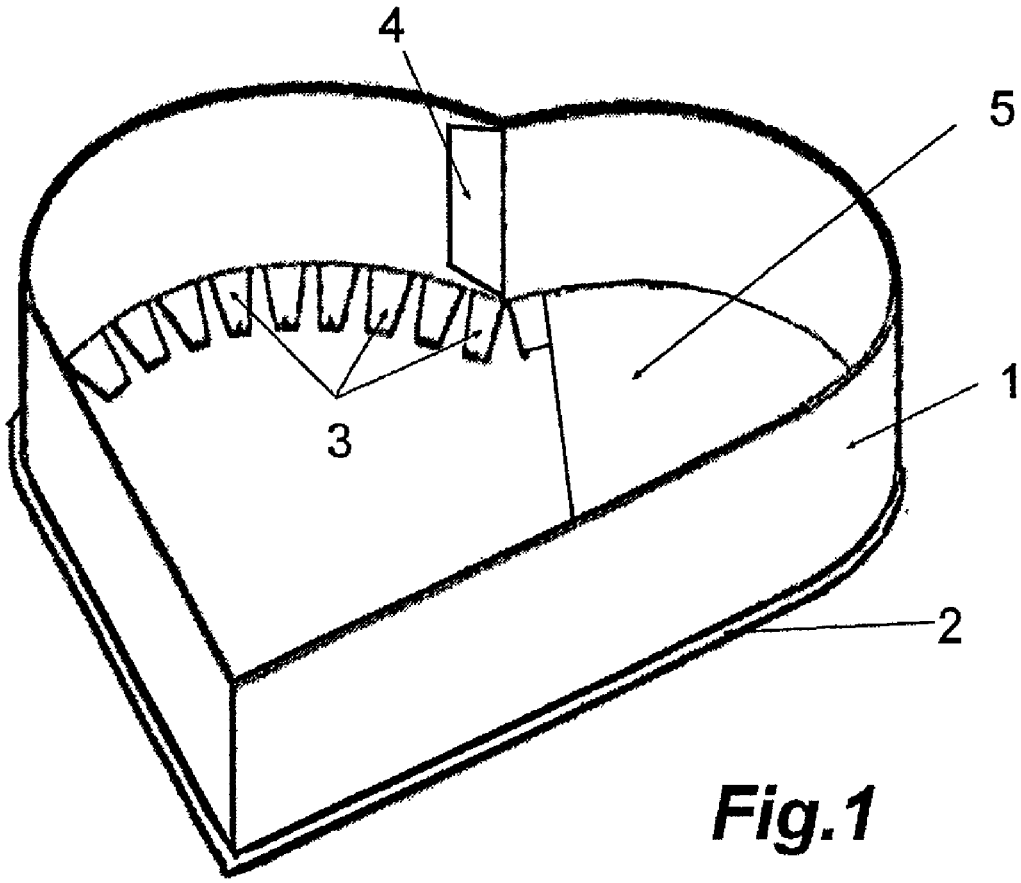
FIG. 1 shows a lower part of a box with a heart shape.

FIG. 1 shows schematically a lower part of a paper or cardboard box with a heart shape. Box shapes of this type are often used for chocolates. Boxes may also have the shape of a Christmas tree, Santa Claus, an Easter rabbit, an Easter egg, an apple, or a star. All of these box shapes have in common that they cannot be manufactured with the box erecting devices which are known and have proven to be effective for cubic boxes.

As FIG. 1 shows, the depicted box lower part includes a base 2 made of paper or cardboard, on which there is a sidewall, having an elongated strip 1 made of paper or cardboard, which is glued to form a ring by means of overlapping at strip beginning 4 and is then glued onto base 2. Connecting tabs 3 are provided for gluing. It is also possible, however, to glue strip 1 in a butt-joint manner to base 2. If connecting tabs 3 are not to be visible, a so-called interior mirror 5 (only shown in areas) is glued in.

The manufacture of a matching box lid occurs basically in the same manner; only the dimensions must be adjusted.

Figure 2:
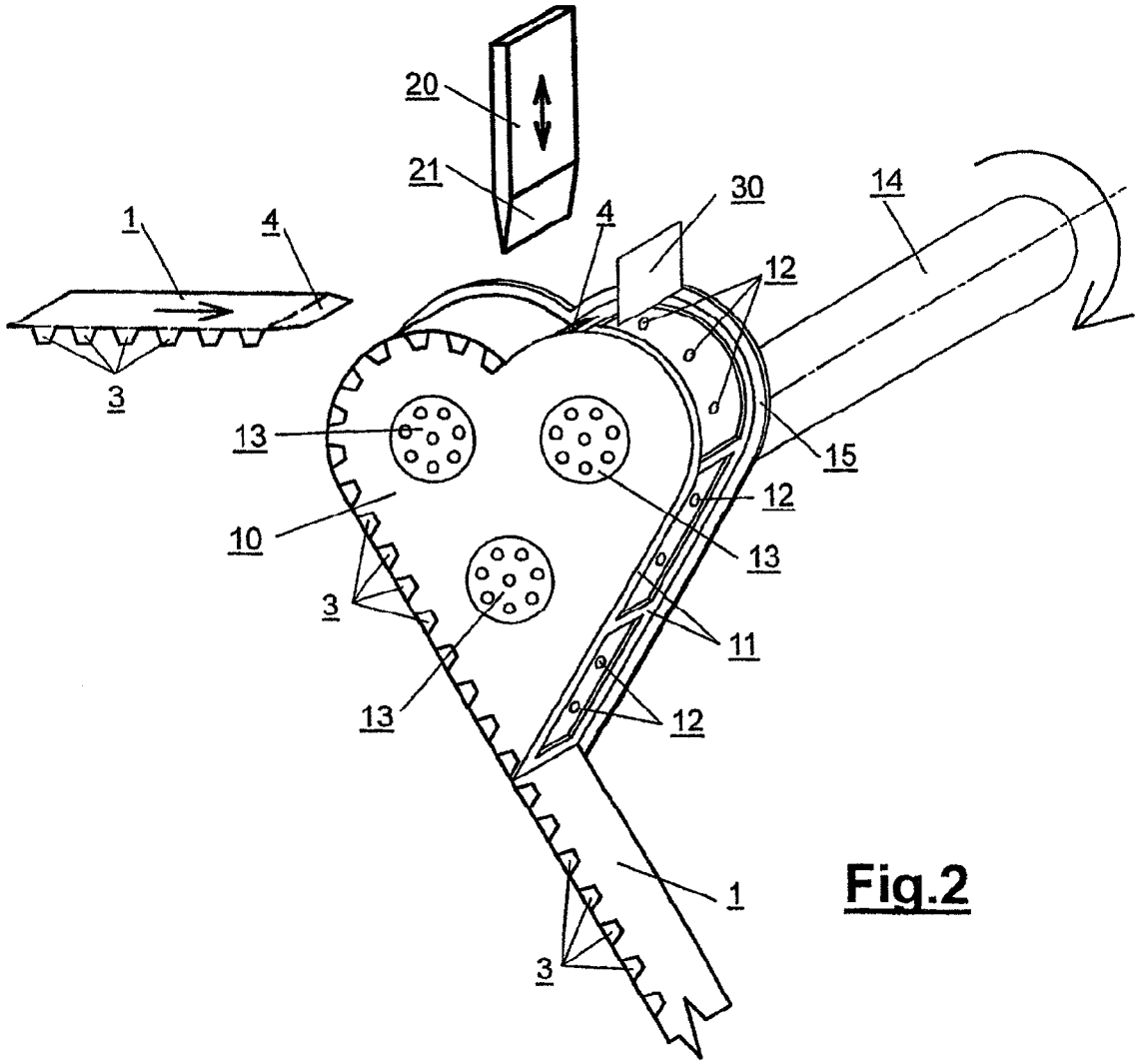
FIG. 2 shows the elements of an apparatus for manufacturing the heart-shaped paper or cardboard boxes according to FIG. 1.

The apparatus illustrated purely schematically in FIG. 2 for manufacturing the box shown in FIG. 1 has a matrix 10 and a patrix 20 as the major components.

Matrix 10 forms the heart of the apparatus. A cylinder is evident whose base area corresponds to box 1, 2 to be manufactured; therefore it is also heart-shaped. Openings 12 are provided in areas in lateral surface 11 of matrix 10. These can be connected to a vacuum source (not shown) via vacuum connections. It is possible in this way to shape strip 1 into a sidewall by means of vacuum at lateral surface 11 of matrix 10 and to fix it in position until base 2 is glued on. A guide edge 15 guarantees the exact position of strip 1 on matrix 11.

To be able to determine whether a strip 1 lies correctly on lateral surface 11 and closes openings 12, pressure sensors can be introduced into the vacuum lines.

As can be seen in FIG. 2, strip 1 with connecting tabs 3, already folded over by about 90°, is pushed forward until strip beginning 4 encounters a stop 30. Patrix 20 then travels downward and positions strip beginning 4 precisely in the concave indentation of the heart-shaped matrix 10. There, strip beginning 4 is held in place by a vacuum nozzle.

Next, matrix 10 is turned with the help of its connecting axis 14, to which it is attached replaceably. In this regard, strip 1 is wound onto lateral surface 11. If necessary, the winding is supported by patrix 20 traveling back and forth in a controlled manner.

As soon as strip 1 has been wound totally onto matrix 10, the end of the strip is pressed against strip beginning 4 with the help of patrix 20, until the previously applied adhesive has hardened.

Next, a box base (not shown) is removed from a tray in a manner known per se with the aid of a vacuum arm and provided with an adhesive bead along the periphery with the help of an adhesive nozzle. Said base is now pressed with the help of the vacuum arm onto matrix 10, connecting tabs 3, and strip 1, forming the sidewall, until the adhesive has hardened. Next, the completed box is removed from matrix 10 with the help of the same or a different vacuum arm, whereby the removal process is supported in that air is blown out of vacuum nozzles 12, 13.

Vacuum nozzles 13 provided in the base of matrix 10 have the task of holding in place interior mirror 5, which is placed on matrix 10, before strip 1 has been wound onto the lateral surface.

The supplying of the vacuum to vacuum nozzles 12, 13 occurs through a vacuum rotary feedthrough integrated into axis of rotation 14.

The trays, which stock the blanks for the sidewall, base, and interior mirror, are not shown in the figures. The apparatuses, which remove the blanks from the trays and supply them to the processing stations, are likewise not shown. The vacuum source is also not shown. These functional elements are realized by conventional technology. If shown in the drawing, these would be unclear and therefore not understandable.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A method for manufacturing a box made of paper or cardboard, the box having a base or a lid with a glued-on sidewall, the sidewalls being formed from a strip with a beginning, an end, and connecting tabs on a long side, the method comprising:

bending the connecting tabs by about 90 degrees;

placing, with the aid of a patrix, the strip beginning against a lateral surface of a cylindrical matrix whose cross section corresponds to a cross section of the box;

attaching the strip via a vacuum to a section of the lateral surface, wherein the connecting tabs are placed against the base area of the matrix;

rotating the matrix, wherein the strip is suctioned onto a convex section of the matrix and is held in place;

applying an adhesive at the beginning or end of the strip;

gluing the strip beginning and strip end;

applying an adhesive bead along a periphery of the base;

pressing the base and adhesive onto the connecting tabs; and removing the finished box from the matrix.

2. The method according to claim 1, wherein a cross section of the box has more than one concave section and more than one convex section, the method further comprising:

pressing the strip onto the concave section of the lateral surface with the help of the patrix;

rotating the matrix to the next concave section of the lateral surface; and repeating the pressing and rotating steps according to a number of concave sections along the box periphery.

3. The method according to claim 1, wherein the patrix is matched to a concave section of the matrix.

4. The method according to claim 1, wherein a stop, configured as a light barrier for positioning the beginning of the strip precisely relative to the matrix, is provided.

5. The method according to claim 1, wherein openings are provided in the lateral surface of the matrix, the openings being connectable to a vacuum source.

6. The method according to claim 5, wherein the openings in the lateral surface of the matrix are divided into groups, and wherein each group is connectable to the vacuum source via a controlled vacuum connection.

7. The method according to claim 5, wherein pressure sensors are activated in lines from the vacuum source to the matrix.

8. The method according to claim 1, wherein a height of the lateral surface is matched to a height of the strip.

9. The method according to claim 1, wherein suction openings are provided in the base area of the matrix.

10. The method according to claim 1, wherein the matrix is removably attached to an axis of rotation.

11. The method according to claim 1, wherein the patrix is configured as a traveling ram with a cutting edge that is matched to the concave section of the matrix.

12. The method according to claim 1, wherein adhesive nozzles are provided for applying the adhesive.

13. The method according to claim 1, further comprising providing a guiding edge for the strip on the lateral surface of the matrix.

14. A method for manufacturing a box made of paper or cardboard, the box having a base or a lid with a glued-on sidewall, the sidewalls being formed from a strip with a beginning, an end, and connecting tabs on a long side, the method comprising:

bending the connecting tabs by about 90 degrees;

placing, with the aid of a patrix, the strip beginning against a lateral surface of a cylindrical matrix whose cross section corresponds to a cross section of the box;

rotating the matrix, wherein the strip is suctioned onto a convex section of the matrix and is held in place;

applying an adhesive at the beginning or end of the strip;

gluing the strip beginning and strip end;

applying an adhesive bead along a periphery of the base;

pressing the base and adhesive onto the connecting tabs; and removing the finished box from the matrix, wherein the strip is fastened to a portion of the lateral surface, the fastening of the strip being effected by a vacuum, and wherein the connecting tabs are applied against the base area of the matrix.

15. The method according to claim 14, wherein a cross section of the box has more than one concave section and more than one convex section, the method further comprising:

pressing the strip onto the concave section of the lateral surface with the help of the patrix;

rotating the matrix to the next concave section of the lateral surface; and repeating the pressing and rotating steps according to a number of concave sections along the box periphery.

16. A method of producing boxes from paper or cardboard, wherein the boxes have a base or a lid with glued-on side wall and the side wall is formed from a strip with a beginning, an end, and connecting tabs on a longitudinal side, comprising the steps of:

bending over the connecting tabs through approximately 90°;

applying the strip beginning to the circumferential surface of a cylindrical matrix, the cross section of which corresponds to the cross-section of the box, by means of a punch;

rotating the matrix, wherein the strip is suctioned on to a convex portion of the matrix and retained thereon;

applying adhesive to the beginning or end of the strip;

pressing the base and adhesive on to the connecting tabs; and removing the finished box from the matrix, wherein fastening of the strip to a portion of the circumferential surface is effected by vacuum, wherein the connecting tabs are applied against the base surface of the matrix.

17. The method according to claim 16, wherein a cross section of the box has more than one concave section and more than one convex section, the method further comprising:

pressing the strip onto the concave section of the lateral surface with the help of the patrix;

rotating the matrix to the next concave section of the lateral surface; and repeating the pressing and rotating steps according to a number of concave sections along the box periphery.

* * * * *

UNITED STATES PATENT AND TRADEMARK OFFICE

CERTIFICATE OF CORRECTION

PATENT NO. : 8,382,648 B2
APPLICATION NO. : 12/710144
DATED : February 26, 2013
INVENTOR(S) : Demuss It is certified that error appears in the above-identified patent and that said Letters Patent is hereby corrected as shown below:

Title Page, item (73) Assignee: should read as follows: Mohrbach Verpackungsmaschinen GmbH Signed and Sealed this
Fourteenth Day of May, 2013

Teresa Stanek Rea
*Acting Director of the United States Patent and Trademark Office*